US007831327B2

(12) United States Patent
Stocker

(10) Patent No.: US 7,831,327 B2
(45) Date of Patent: Nov. 9, 2010

(54) PRECISION ABRASIVE MACHINING OF WORK PIECE SURFACES

(75) Inventor: Mark Andrew Stocker, Market Harborough (GB)

(73) Assignee: Corning Incorporated, Corning, NY (US)

( * ) Notice: Subject to any disclaimer, the term of this patent is extended or adjusted under 35 U.S.C. 154(b) by 233 days.

(21) Appl. No.: 11/998,691

(22) Filed: Nov. 30, 2007

(65) Prior Publication Data

US 2008/0132148 A1 Jun. 5, 2008

Related U.S. Application Data

(60) Provisional application No. 60/872,009, filed on Nov. 30, 2006.

(51) Int. Cl.

| | |
|---|---|
| ***G06F 19/00*** | (2006.01) |
| ***H01L 21/461*** | (2006.01) |
| *B24B 49/00* | (2006.01) |
| *B24B 5/00* | (2006.01) |

(52) U.S. Cl. ..... 700/117; 438/691; 451/5; 451/287

(58) Field of Classification Search ..... 700/117; 438/691; 451/287, 5

See application file for complete search history.

(56) References Cited

U.S. PATENT DOCUMENTS

| | | | | |
|---|---|---|---|---|
| 4,679,271 | A * | 7/1987 | Field et al. | 15/52.1 |
| 5,951,370 | A * | 9/1999 | Cesna | 451/21 |
| 5,980,368 | A * | 11/1999 | Chang et al. | 451/303 |
| 6,165,057 | A * | 12/2000 | Gill, Jr. | 451/287 |
| 6,421,576 | B1 * | 7/2002 | Sermund | 700/160 |
| 6,506,105 | B1 | 1/2003 | Kajiwara et al. | 451/289 |
| 6,517,414 | B1 * | 2/2003 | Tobin et al. | 451/8 |
| 6,558,232 | B1 | 5/2003 | Kajiwara et al. | 451/41 |
| 6,796,877 | B1 * | 9/2004 | Bingham et al. | 451/5 |
| 7,312,154 | B2 * | 12/2007 | Cites et al. | 438/691 |
| 2005/0037698 | A1 | 2/2005 | Zuniga et al. | 451/287 |
| 2005/0166726 | A1 | 8/2005 | Montesanti et al. | 82/1.11 |
| 2005/0266658 | A1 | 12/2005 | Couillard et al. | 438/455 |
| 2007/0138141 | A1 | 6/2007 | Cites et al. | 216/84 |
| 2007/0246450 | A1 | 10/2007 | Cady et al. | 219/250 |

FOREIGN PATENT DOCUMENTS

| | | |
|---|---|---|
| WO | WO97/00155 | 1/1997 |

* cited by examiner

*Primary Examiner*—Albert DeCady
*Assistant Examiner*—Thomas H Stevens
(74) *Attorney, Agent, or Firm*—Bruce P. Watson; Matthew Dernier, Esq.

(57) ABSTRACT

The spacing between an abrasive type surface polishing tool and the surface of the work piece that is being polished is controlled dynamically so that variations in the area of the abrasive pad in contact with the surface of the work piece compensated, thereby eliminating size variations in this contact area and the accompanying variations in material removal that produce surface height fluctuations.

17 Claims, 7 Drawing Sheets

PRECISION ABRASIVE MACHINING OF WORK PIECE SURFACES

CROSS REFERENCE TO RELATED APPLICATIONS

This application claims the benefit of priority under 35 U.S.C. §119(e) of U.S. Provisional Application Ser. No. 60/872,009 filed on Nov. 30, 2006.

BACKGROUND OF THE INVENTION

The present invention relates generally to machine control and, more particularly, concerns a method and a system for precision machining or finishing of article surfaces. It finds application, among other uses, in polishing of the semiconductor layer of semiconductor-on-insulator structures.

The present invention will be disclosed in terms of a particular application. However, other applications are disclosed and further applications will be apparent to those skilled in the art. Particular applications were disclosed for convenience of description and without the intention of limiting the invention to any of them.

To date, the semiconductor material most commonly used in semiconductor-on-insulator structures has been silicon, and glass is a common insulator. Silicon-on-insulator technology is becoming increasingly important for high performance thin film transistors, solar cells, and displays, such as active matrix displays. Silicon-on-insulator wafers consist of a thin layer of substantially single crystal silicon (generally 0.1-0.3 microns in thickness but, in some cases, as thick as 5 microns) on an insulating material.

Once the semiconductor-on-insulator structure has been bonded to a thin film of silicon, it is typically necessary to polish the surface of the silicon layer to produce a layer having a substantially uniform thickness, in order to facilitate the formation of thin film transistor (TFT) circuitry on the silicon.

As a specific example, silicon-on-glass (SiOG) substrates are subjected to a machining process that thins the surface film. This is commonly performed by "deterministic polishing," an abrading process performed by a tool that has a substantially smaller polishing contact zone than the component being machined. This type of process is typically performed today by the use of ultra-precise optical lens polishing machines, a well-known source of which is Zeeko Limited of Coalville, Leicestershire, UK. A machine of this type is disclosed in U.S. Pat. No. 6,796,877, entitled ABRADING MACHINE and issued to Bingham et al. On Sep. 28, 2004. As is typical, precision movement between a machine tool and work piece is provided in three Cartesian coordinates, in order to achieve machining of the entire surface.

The machining tool of the type disclosed in U.S. Pat. No. 6,796,877 may be referred to herein as a bonnet/pad machine, and is illustrated schematically in FIG. 1. The tool 10 has a generally cylindrical body 12 and a working head or bonnet 14 which is internally pressurized to a predetermined pressure. For example, the bonnet may be a partially spherical or bulbous, fiber reinforced rubber diaphragm. A polishing pad 16 is bonded onto the surface of bonnet 14. In operation, the pad 16 is applied to a surface of the component being machined and is rotated about an axis of rotation A, in order to abrade the surface.

Prior to use, the tool must be calibrated to the work piece surface to be machined. In order to do this, the pad 16 is touched to the surface at a number of points in a predetermined pattern. Tool 10 is provided with a positioning mechanism 19 providing precision movement along three axes and the axial movement corresponds to the Z-axis control. In performing the calibration, when the pad 16 is touched to one of the calibration points on the surface, bonnet 14 is moved axially until a predetermined force is sensed by a sensor 18 provided in tool 10. This assures consistency of contact. After a set of calibration points has been taken, tool movement can be controlled to assure that the bonnet will remain in a plane or other appropriate contour corresponding to the intended finished shape of the surface to be machined. In addition, an appropriate axial spacing of bonnet 14 relative to the surface to be polished will be maintained. This is normally an interference spacing that would place the front of the bonnet past the surface of the work piece, causing compression of the bonnet against the surface. The actual machining process is then performed by rotating bonnet 14 and simultaneously moving it in a predetermined scanning pattern along a contour (e.g., a plane) relative to the work piece surface to be machined. Although different scanning patterns are available, the most common pattern is a series of closely spaced parallel lines or a "raster", similar to the line pattern scanned on a cathode ray tube of a traditional television set.

The requirements for SiOG film thinning are quite stringent. It would be desirable for the final film thickness to be controlled with an accuracy of about ±8 nm. It is known that material removal is approximately linearly proportional to the scan rate of the bonnet and the bonnet rotational speed. However, it is proportional to the square of the polishing spot size, or the area of the pad which actually performs the abrasion. Polishing spot size is controlled by the amount of force between the bonnet and the surface being machined, which results from its interference contact with the surface to be polished. All of these parameters are well understood, and current polishing practice closely controls them.

It has been found that deviations in the rotation of bonnet 14 have a profound effect on material removal. Such deviations could be measured by rotating bonnet 14 and measuring the amount of radial (eccentric) movement, which will be referred to herein as "radial error motion." It will be appreciated that any eccentricity in pad rotation will make the spot size effectively larger, resulting more material removal than expected, at high rotational speeds and time variable material removal at low rotational speeds. It has been found that a radial error motion of approximately 50 microns may result in a film thickness variability of approximately 15 nm, larger than the total film thickness tolerance. Every effort is made to minimize the combined radial error motion of the bonnet and pad (e.g., by diamond turning and/or cup grinding in situ). However, this radial error motion can rarely be reduced below 30 microns.

It is therefore clear that, in order to achieve the required film thickness control when performing the deterministic polishing with a bonnet/pad type machine, the bonnet spot size must be controlled to tighter tolerances than can be achieved by bonnet truing.

SUMMARY OF THE INVENTION

In accordance with the present invention, the relative spacing between a bonnet/pad type tool and the surface of the work piece is controlled dynamically so that the area of the abrasive pad in contact with the surface of the work piece (also referred to herein as "spot size") remains constant, thereby eliminating spot size variations and the accompanying variations in material removal, which produce surface height fluctuations. Spot size variation results from various sources including radial error motion of the pad. For a given internal pressure of the tool, the spot size will vary in relationship to the actual axial position between the tool and the work piece surface. In accordance with a first embodiment of the invention, the force between the tool and the surface of the work piece is sensed and the axial spacing between the tool and the surface of the work piece is controlled in reverse sense to the force variation, in order to compensate for changes in spot size. In accordance with this first embodiment, dynamic real time control is exercised, for example, by using a server control subsystem.

In accordance with a second embodiment, the variation of a parameter which affects spot size is measured prior to use. For example, radial error motion of the pad as it rotates may be measured and stored. Using the stored information, during operation, a time varying adjustment in the distance between the tool and the surface of the work piece is then made, as the pad rotates. That distance adjustment compensates for radial error motion, producing a uniform spot size.

In general, the distance between the tool and work piece surface is controlled by axial movement of the tool. However, in accordance with a third embodiment, the work table supporting the work piece is itself has at least one, and optionally a plurality of actuator/position-sensor pairs spaced in a two dimensional pattern under the table. The actuators are controlled to adjust table elevation to change the distance between the tool and work piece so as to compensate for spot size variation. This permits not only control of the spacing between the tool and the work piece surface, but also the tilt of the work piece surface in three dimensions to control orthogonality.

BRIEF DESCRIPTION OF THE DRAWINGS

The foregoing brief description and further objects, features, and advantages of the present invention will be understood more completely from the ensuing detailed description of specific embodiments in accordance with the present invention, with reference being had to the accompanying drawings, in which.

DETAILED DESCRIPTION OF THE SPECIFIC EMBODIMENTS

Figure 1:
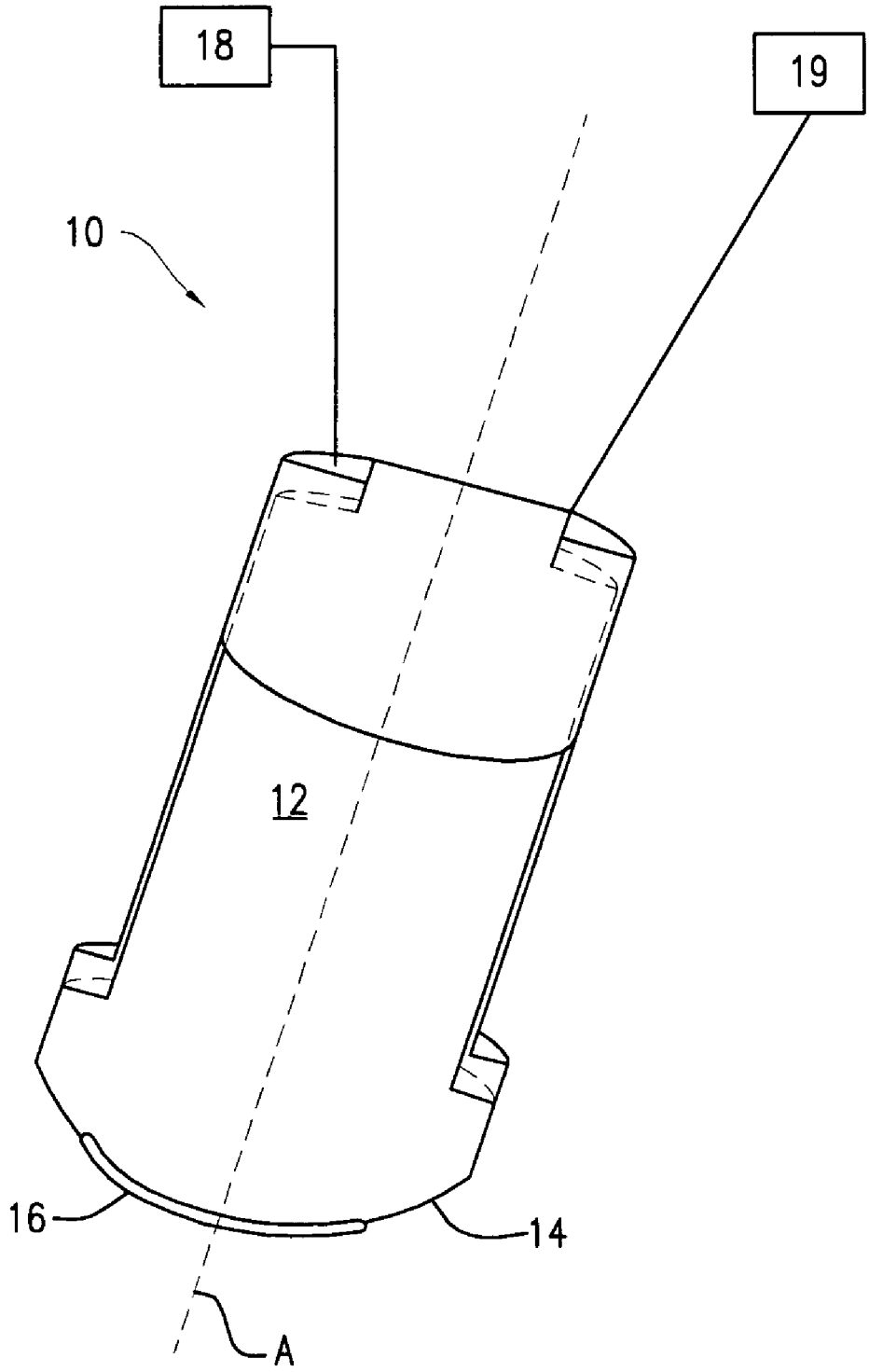
FIG. 1 (PRIOR ART)
FIG. 1 is a schematic diagram illustrating a bonnet/pad type abrasive polishing tool.
Figure 2:
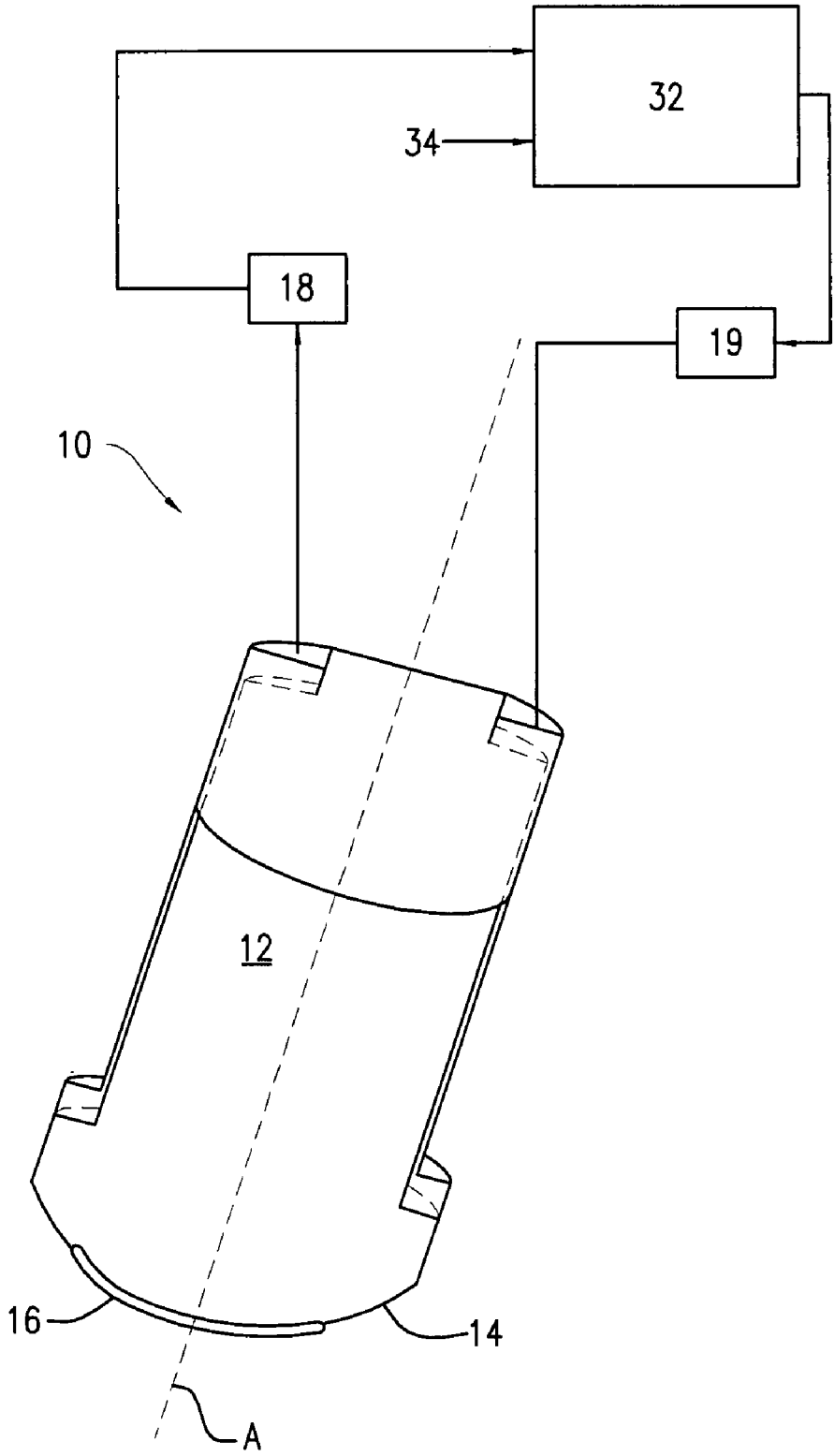
FIG. 2 is a schematic/block diagram representing a first embodiment in accordance with the present invention in which dynamic servo control is provided of the distance between the tool and the work piece surface in relationship to the force therebetween.

FIG. 2 is a schematic/block diagram illustrating a first embodiment in accordance with the present invention. Specifically, there is disclosed a tool 10 as in FIG. 1 in combination with a control subsystem 32, which controls the spacing between tool 10 and the surface of a work piece in relationship to the force between them.

The work piece may be a silicon-on-insulator (SOI) structure, such as silicon-on-glass (SOG). As used herein, "silicon-on-insulator" or "silicon-on-glass" shall be construed more broadly as including semiconductor materials other than silicon or those including silicon, and it will be understood to embrace insulator materials other than glass. For example, other useful semiconductor materials for practicing the invention include, but are not limited to, silicon germanium (SiGe), silicon carbide (SiC), germanium (Ge), gallium arsenide (GaAs), GaP, and InP. Also for example, other insulator materials may be employed for practicing the invention, including, but not limited to, various well known silicones and ceramics. Methods and apparatus in accordance with the invention may also find substantially broader application to industry, for example to ultra-precise lens polishing and other surface machining technologies.

Some discussion is in order about the source of spot size variation which results in height fluctuations of the finished surface of the work piece when using a bonnet/pad type tool 10. The tool is constructed to have a precisely controlled pressure inside the bonnet 14. When the bonnet 14 is pressed against the surface of the work piece, a portion of the pad 16 is flattened against the surface and, upon rotation, will interact abrasively with the work piece surface to remove material. This flattened portion has been referred to herein, as the "spot size," and material removal will vary as the square of the spot size (i.e., its area). Inasmuch as the bonnet 14 has a precisely controlled internal pressure, the force between the bonnet 14 and work piece will be equal to the product of the spot size (area) and the internal pressure. If the spot size changes during rotation of the tool, for example, owing to radial error motion, the effective spot size during rotation of the tool is increased, resulting in more material removal than expected. It will also result in the force between the tool and work piece being greater than expected.

For the present embodiment, the Z-axis control of positioning mechanism 19 of tool 10 moves the body 12 along the axis A in FIG. 2. Initially, the tool 10 is positioned relative to the surface of the work piece, so that the force between them, as sensed by sensor 18, is that force necessary to produce the desired spot size. This predetermined "reference force" or "applied force" is stored in the form of a reference force signal 34, and it is applied as an input to control subsystem 32. During operation, sensor 18 senses the force between body 12 and the surface of the work piece and produces a signal representing that actual force, which is applied as a second input to control subsystem 32. Control subsystem 32 then produces a control signal (or driving signal or difference signal) which operates the Z-axis control of positioning mechanism 19 to adjust the distance between body 12 and the surface of the work piece so as to compensate for force variations sensed by sensor 18, e.g. to compensate for variations between the reference force and the sensed actual force.

The sensor 18 may be a load cell which is mounted inside tool 10. However, a load cell requires relative motion in order to provide a measurement of force has a somewhat limited sensitivity. In accordance with one variation of the first embodiment, a piezoelectric stack force sensor, which is highly rigid and requires orders of magnitude less displacement than a typical load cell in order to produce a signal, may be used in place of sensor 18, in order to gain an improvement in sensitivity.

Figure 3:
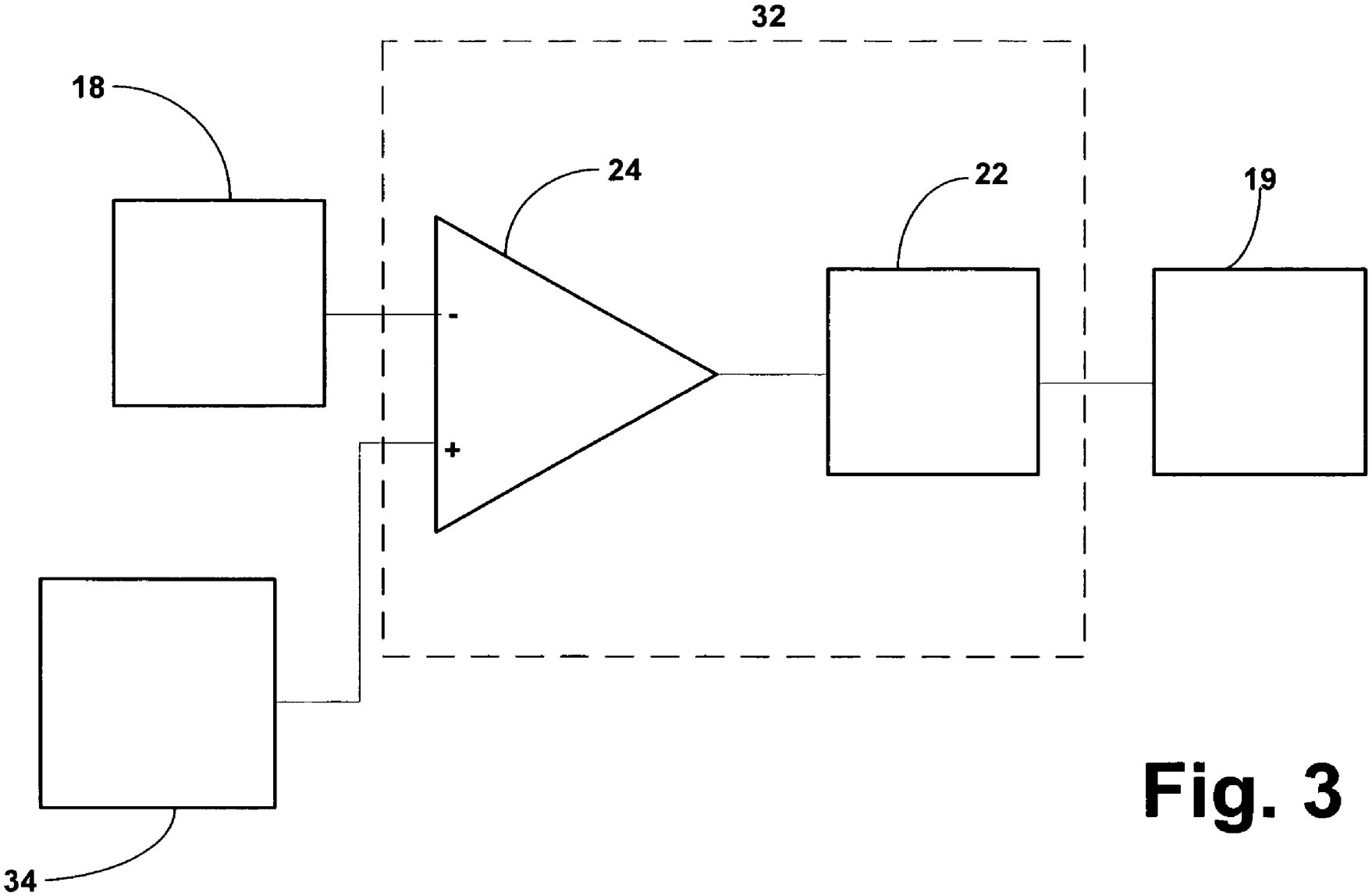
FIG. 3 is a functional block diagram representing the structure and operation control of the servo control subsystem 32 of FIG. 2.

FIG. 3 is a functional block diagram representing the structure and operation of control subsystem 32. Subsystem 32, itself, is modeled herein as an operational amplifier 24 and a bandwidth filter 22. This has been done for convenience of explanation, and those skilled in the art will understand that this type of servo control system is typically much more complex. The output signal of force sensor 18 and the force reference signal 34 are applied differentially to amplifier 24. The output signal of amplifier 24 passes through the bandwidth filter 22 and is then applied as a difference signal (or correction signal or driving signal) to the Z-axis control of positioning mechanism 19.

In operation, the Z-axis control of the machine is operated in the usual manner to place the bonnet 14 into contact with the surface of the work piece so that a predetermined force is attained. This predetermined force will be the applied force necessary to achieve the intended spot size. At that point, the value of the signal produced by the force sensor 18 is saved as reference signal 34. The operation of control subsystem 32 is similar to that of an operational amplifier, in the sense that it produces an output signal that will cause the Z-axis motion to make the force sensor 18 signal equal the reference signal 34. In other words, as the spot size deviates from the intended value, the Z-axis motion changes the distance between body 12 and the surface of the work piece so as to cancel the change in spot size. Thus, there is a dynamic, time varying adjustment of the distance between body 12 and the surface of the work piece.

Control subsystem 32 compensates for many and possibly all variations in spot size. The sources of such variations include bonnet radial error motion, bonnet geometry creep, thickness and flatness variations in the work piece, and machine orthogonality and axis straightness errors.

Filter 22 represents the design bandwidth of control subsystem 32, and its bandwidth will depend upon the application and the particular machine used. For a bonnet/pad machine used to polish the surface layer on an SiOG substrate, the bonnet rotational speed is typically around 200 rpm (3.3 Hz). However, there can typically be 10 ripple error motions superimposed upon each revolution of the bonnet 14. In order to correct for all of these, the bandwidth of filter 32 would need to be in excess of 33 Hz. If the bonnet 14 were rotated at its maximum speed of 2,000 rpm, compensation for all ripple error motions would require a bandwidth in excess of 330 Hz. This may not be achievable with a typical positioning mechanism that has a high mass in the Z-axis direction.

Figure 4:
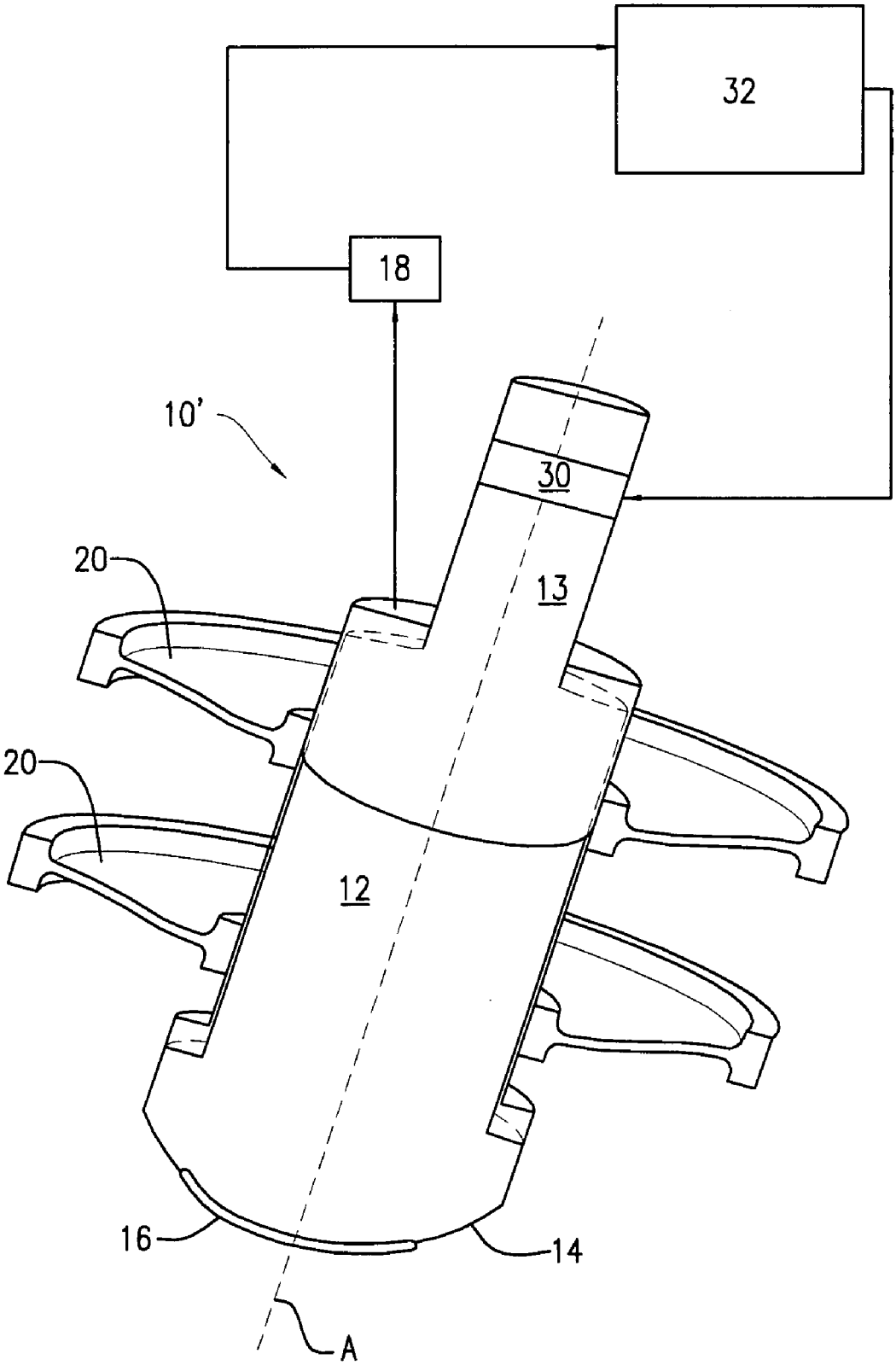
FIG. 4 is a schematic/block diagram representing a variation of the first embodiment in accordance with the present invention which achieves high speed operation

In order to achieve operation with high speed rotation, a second modification is made to the first embodiment. With reference to FIG. 4, the modification is made to tool 10 of FIG. 2 to produce a tool 10'. The modification comprises mounting a linear actuator 30 on body 12 in order to achieve small axial movements thereof. The actuator 30 is of very low mass in order to achieve the positioning bandwidth required for high speed rotation. In this case, actuator 30 is a piezoelectric actuator stack mounted on a spindle 13 for body 12. By providing flexible mounts 20, 20 which are compliant in only the axial direction, an extremely low mass construction is obtained. Those skilled in the art will appreciate that other types of linear actuators, for example, a voice coil or a linear motor, could be used in place of the piezoelectric crystal stack. Although a modified tool 10' is being utilized, the operation of this variation of the first embodiment is the same as illustrated in FIGS. 2 and 3.

Figure 5:
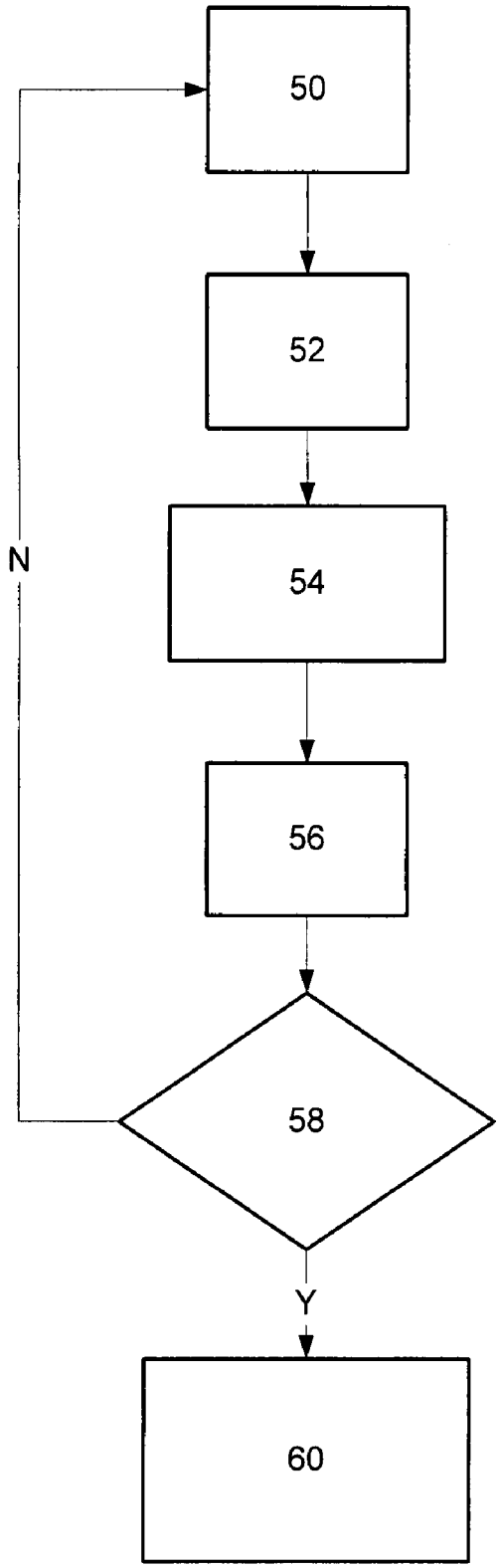
FIG. 5 is a flow chart illustrating the process performed in accordance with a second embodiment in accordance with the present invention.

FIG. 5 is a flow chart illustrating the process of a second embodiment in accordance with the present invention. In this case, tool 10 or 10' is operated to compensate for spot size variations without using a servo control system. Periodically (e.g., daily) positioning mechanism 19 is subjected to a learning operation. This involves an initial step that simulates actual operation by setting the tool 10 to a reference rotational orientation and setting the reference or applied force between tool 10 and the work piece so as to create the desired spot size and the reference force is stored in memory. This step is depicted in block 50. The angular orientation of body 12 may then be incremented by rotating the body about axis A by a predetermined amount (block 52). The tool to work piece spacing is then adjusted to remove any change that may have occurred in the actual force sensed by sensor 18 (block 54), e.g. to remove any difference between the reference force (or applied force) and the sensed actual force, and the change in spacing is stored in memory as a spacing change (or distance adjustment) (block 56). By virtue of a test performed at block 58, the steps in block 52-56 are repeated until body 12 has completed a 360° rotation about axis A and returned to its reference orientation, thereby completing a simulation of a full rotation of the tool, and a sequence of spacing changes (or sequence of distance adjustments) has been stored in memory. Actual polishing of the work piece is then begun and the sequence of spacing changes (or sequence of distance adjustments) is played back from memory in synchronism with the time varying rotational position of bonnet 14 (block 60). In this manner, spot size variations are compensated for during each rotation of the bonnet. Once the control processor for the positioning mechanism 19 is trained, each time a new work piece is to be polished, it is only necessary to adjust positioning mechanism 19 so that the force between tool 10 and the work piece is at the nominal or reference value while bonnet 14 is in the reference position. Polishing may then commence, and the stored sequence of distance adjustments will be played back as a difference signal (or correction signal or driving signal) to control the positioning mechanism 19 to compensate for spot size variations.

Figure 6:
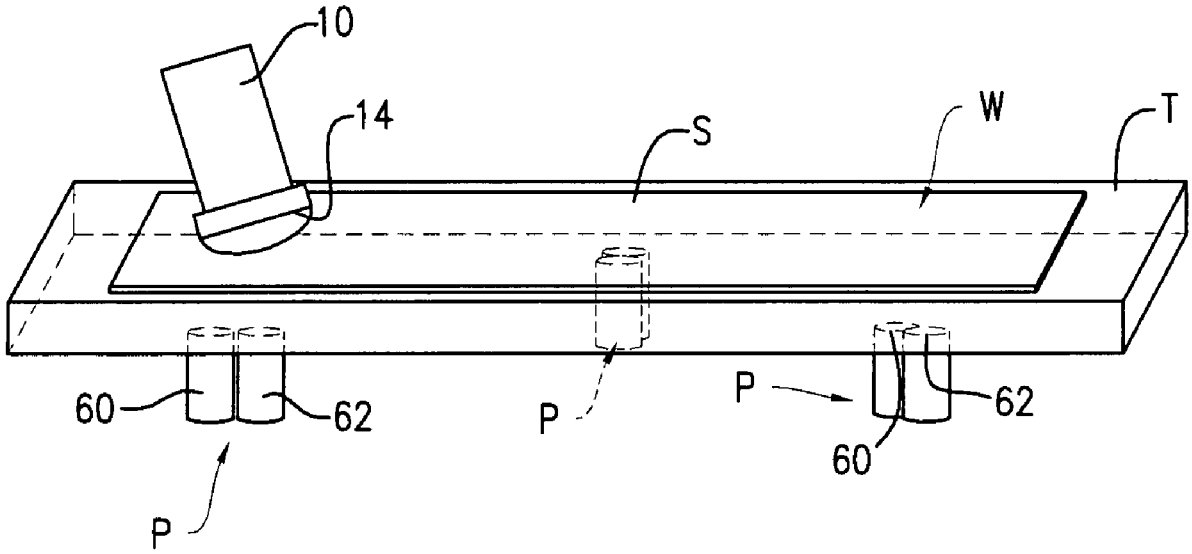
FIG. 6 is a schematic diagram illustrating a third embodiment in accordance with the present invention.

FIG. 6 is a schematic diagram illustrating a third embodiment in accordance with the present invention. In this case, the work piece W is supported on a table T with the tool 10' positioned over the surface S of the work piece W. In operation, tool 10 would be scanned with respect to the surface S. This could be achieved by translating the tool 10 making use of its positioning system 19 (see FIG. 19) and/or translating the table T. Below the table T, there are provided a plurality of distance sensor/actuator pairs P each including a sensor 60 and a linear actuator 62. In this embodiment, there are three such pairs P, and they are in a triangular arrangement. The tool 10 is used to orthogonalize the table in the usual manner. That is, with table T empty, the tool 10 is positioned over the surface S, for example, over the left most pair P, and using its positioning mechanism 19 the distance between tool 10 and surface S is adjusted until sensor 18 senses a predefined force. Thereafter, tool 10 may be positioned over each of the pairs P in turn and the respective actuator 62 is operated to raise or lower the table T until sensor 18 once again measures the desired force. At the conclusion of this operation, table T is orthogonalized. That is, the operating plane of tool 10 is parallel to the plane of table T. Thereafter, the work piece W is placed upon the table, tool 10 is positioned over one of the pairs P, and the distance between tool 10 and surface S is adjusted until sensor 18 reads a force corresponding to the desired spot size. Polishing may then begin.

As was the case with the first embodiment (FIG. 2), the actual force measured by sensor 18 is monitored constantly and the distance between surface S and tool 10 is adjusted to compensate for changes in this force. However, in this case, the actuators 62 of pairs P are operated to achieve the space adjustment.

Figure 7:
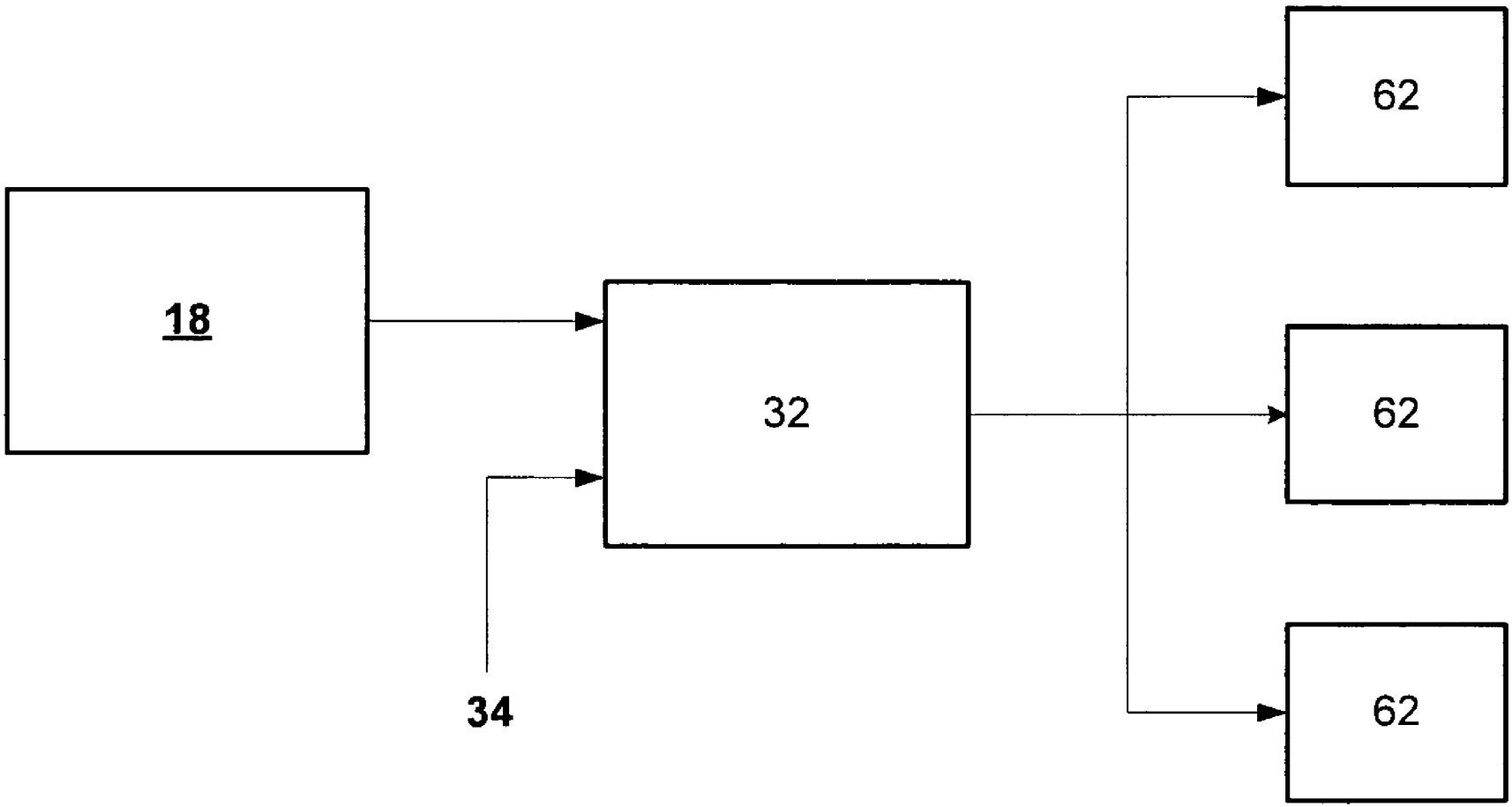
FIG. 7 is a block diagram illustrates how spacing control is achieved in accordance with the present embodiment.

The schematic diagram of FIG. 7 illustrates how spacing control is achieved in accordance with the present embodiment. When the force is originally set to achieve the desired spot size, a signal corresponding to that force is saved as a reference force 34, as in FIG. 2. Sensor 18 measures the actual force between tool 10 and surface S as the tool progresses over the surface S, and all actuators 62 are adjusted simultaneously to change the spacing between tool 10 and surface S so as to compensate for any change in the actual force, e.g. any difference between the reference force (or applied force) and the actual force, as was the case in FIG. 2. However, since all of the actuators operate simultaneously, the orthogonality of table T will be maintained. Thus, in this embodiment, not only is there compensation for spot size variations due to tool 10, but also for spot size variations due to orthogonality errors of table T.

Control subsystem 32 is substantially identical to the correspondingly numbered subsystem in FIG. 2, and actuators 62 may be load cells, piezoelectric crystal stack actuators, voice coils, linear motors, and the like. The sensors 60 are linear transducers, for example, a capacitance gage. They are provided to insure that each actuator moves table T by precisely the same amount.

Although specific embodiments of the invention have been disclosed for illustrative purposes, those skilled in the art will appreciate that many additions, modifications, and substitutions are possible without departing from the scope and spirit of the invention as defined by the accompanying claims.

What is claimed:

1. In a tool in a machine, the tool including a pressurized chamber behind a yieldable, bulbous carrier for an abrasive layer which is moved against a surface of a work piece to be machined, the abrasive layer being forced against the surface so that a spot of the abrasive layer is retained in abrasive contact with the surface, a method for compensating for variations in a size of the spot during use of the tool, comprising the steps of:

urging the bulbous carrier against the surface with an applied force calculated to produce the spot with a predetermined size;

during operation of the tool, comparing an actual force between the bulbous carrier and the surface with the applied force;

adjusting a distance between the tool and the surface to compensate for any difference between the actual force and the applied force, making the actual force and the applied force substantially equal; and wherein the comparing and adjusting steps are performed during a preliminary learning operation of the tool during which actual operation is simulated, a correction signal representing a sequence of distance adjustments being stored, the correction signal being applied as a driving signal for an actuator during actual operation and causing the actuator to change the distance between the tool and the surface so as to compensate for any differences between the actual force and the applied force.

2. The method of claim 1, wherein the comparing step is performed by a servomechanism which is jointly responsive to signals representing the applied force and signals representing the actual force, to produce a driving signal for an actuator which causes the actuator to change the distance between the tool and the surface so as to compensate for any difference between the actual force and the applied force.

3. The method of claim 2 wherein the actuator acts on the tool and moves the bulbous carrier toward and away from the surface.

4. The method of claim 2 wherein the work piece is supported on a table, the tool and the table being relatively moveable, the actuator acting on the table to move the table toward and away from the tool.

5. The method of claim 4 performed with a plurality of actuators arranged in a two-dimensional pattern, the actuators being operated so as to move the table without changing an attitude of the table relative to the tool.

6. The method of claim 2 wherein one of the signal representing the applied force and the signals representing the actual force is produced by a force sensor.

7. The method of claim 6 wherein the force sensor is one of a load cell, and a piezoelectric transducer.

8. The method of claim 1 wherein the comparing step is performed by a servomechanism which is jointly responsive to signals representing the applied force and signals representing the actual force, to produce a driving signal for an actuator which causes the actuator to change the distance between the tool and the surface so as to compensate for any difference between the actual force and the applied force.

9. The method of claim 1 wherein the tool is caused to rotate about an axis during operation, the preliminary learning operation comprises rotating the tool in a series of angular increments from a reference orientation, one of the distance adjustments in the sequence of distance adjustments being made and stored after each increment thereby generating the correction signal, the correction signal being applied to the tool synchronously during a rotation during actual operation.

10. A tool in a machine, the tool including a pressurized chamber behind a yieldable, bulbous carrier for an abrasive layer which is moved against a surface of a work piece to be machined, the abrasive layer being forced against the surface so that a spot of the abrasive layer is retained in abrasive contact with the surface, an improvement for compensating for variations in a size of the spot during use of the tool, comprising:

an actuator initially urging the bulbous carrier against the surface with an applied force calculated to produce the spot with a predetermined size;

a comparator acting during operation of the tool to compare an actual force between the bulbous carrier and the surface with the applied force to produce a difference signal representing the same;

a driver responsive to the difference signal and acting on the actuator to adjust a distance between the tool and the surface to compensate for any difference between the actual force and the applied force, making the actual force and the applied force substantially equal; and wherein the comparator and drivers are operated during a preliminary learning operation of the tool during which actual operation is simulated, a correction signal representing a sequence of distance adjustments being stored, the correction signal being provided to the driver and applied as a driving signal for the actuator during actual operation and causing the actuator to change the distance between the tool and the surface so as to compensate for any differences between the actual force and the applied force.

11. The tool of claim 10, wherein the comparator and driver are part of a servomechanism which is jointly responsive to signals representing the applied force and signals representing the actual force, to produce a driving signal for the actuator which causes the actuator to change the distance between the tool and the surface so as to compensate for any difference between the actual force and the applied force.

12. The tool of claim 11 wherein the actuator acts on the tool and moves the bulbous carrier toward and away from the surface.

13. The tool of claim 11 wherein the work piece is supported on a table, the tool and the table being relatively moveable, the actuator acting on the table to move the table toward and away from the tool.

14. The tool of claim 13 further comprising a plurality of additional actuators, the actuators being arranged in a two-dimensional pattern, the actuators being operated so as to move the table without changing an attitude of the table relative to the tool.

15. The tool of claim 11 wherein one of the signals representing the applied force and the signals representing the actual force are produced by a force sensor.

16. The tool of claim 15 wherein the force sensor is one of a load cell, and a piezoelectric transducer.

17. The tool of claim 10 wherein the tool rotates about an axis during operation, the tool being rotated during the preliminary learning operation in a series of angular increments from a reference orientation, the comparator producing one of the distance adjustments in the sequence of distance adjustments after each increment, the sequence of distance adjustments being stored as a correction signal, and the correction signal being applied to the tool synchronously during a rotation during actual operation.

* * * * *

UNITED STATES PATENT AND TRADEMARK OFFICE

CERTIFICATE OF CORRECTION

PATENT NO. : 7,831,327 B2
APPLICATION NO. : 11/998691
DATED : November 9, 2010
INVENTOR(S) : Mark Andrew Stocker et al.

It is certified that error appears in the above-identified patent and that said Letters Patent is hereby corrected as shown below:

| *Col.* | *Line* | *Description* |
|---|---|---|
| 4 | 46 | After "sensor **18** senses the", please add --actual-- |
| 5 | 4 | After "sensor **18** and the", please delete "force" |
| 5 | 5 | After "reference", please add --force-- |
| 5 | 19 | After "the reference", please add --force-- |
| 6 | 63 | After "changes in this", please add --actual-- |

Signed and Sealed this
Fifteenth Day of March, 2011

David J. Kappos

David J. Kappos
*Director of the United States Patent and Trademark Office*